US009393496B2

(12) United States Patent
Burroughs

(10) Patent No.: US 9,393,496 B2
(45) **Date of Patent: *Jul. 19, 2016**

(54) HUMAN FLYING APPARATUS

(71) Applicant: Elizabeth Wales Burroughs, Buda, TX (US)

(72) Inventor: Elizabeth Wales Burroughs, Buda, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/790,830

(22) Filed: Jul. 2, 2015

(65) Prior Publication Data

US 2016/0144869 A1 May 26, 2016

Related U.S. Application Data

(62) Division of application No. 14/552,112, filed on Nov. 24, 2014, now Pat. No. 9,120,023.

(51) Int. Cl.

| | |
|---|---|
| ***A63G 7/00*** | (2006.01) |
| ***A63G 21/20*** | (2006.01) |
| ***B61B 3/00*** | (2006.01) |
| ***B61B 12/00*** | (2006.01) |

(52) U.S. Cl.
CPC *A63G 21/20* (2013.01); *A63G 7/00* (2013.01); *B61B 3/00* (2013.01); *B61B 12/00* (2013.01)

(58) Field of Classification Search
CPC ..... A63G 21/20; A63G 21/22; A63G 7/00
USPC ..... 104/53, 89, 91, 94, 112, 113, 115, 124, 104/125; 244/4 A
See application file for complete search history.

(56) References Cited

U.S. PATENT DOCUMENTS

| | | | | | |
|---|---|---|---|---|---|
| 301,923 | A * | 7/1884 | Reisdorff | B61B 12/005 | 104/113 |
| 1,684,251 | A * | 9/1928 | Thomas | B61B 12/005 | 104/113 |
| 1,935,711 | A * | 11/1933 | Hecox | A62B 1/14 | 104/113 |
| 2,509,603 | A * | 5/1950 | Marin | B60G 13/14 | 180/180 |
| 3,149,798 | A * | 9/1964 | Moore | B64C 39/026 | 244/4 A |
| 3,150,847 | A * | 9/1964 | Moore | B64C 29/005 | 244/4 A |
| 3,236,477 | A * | 2/1966 | Moore | B64C 39/026 | 244/4 A |
| 3,558,079 | A * | 1/1971 | Curriston | B64G 1/16 | 244/171.1 |
| 3,570,785 | A * | 3/1971 | Croft | B64G 4/00 | 244/4 A |
| 4,040,577 | A * | 8/1977 | Moore | B64C 39/026 | 244/4 A |
| 4,934,277 | A * | 6/1990 | Smith | B61B 12/005 | 104/113 |

(Continued)

*Primary Examiner* — Zachary Kuhfuss
(74) *Attorney, Agent, or Firm* — Matthew E. Burr

(57) ABSTRACT

The lever, wheel and axle, pulley, wedge, screw, and inclined plane are the six Simple Machines of the Classical era. Over 2000 years ago a man from Syracuse used them to create a way to move water against the pull of gravity. The Archimedes' screw is still a standard for simple efficiency. In homage to those early machines and the dreamers who built them, the Human Flying Apparatus provides a carriage, wheels and an axle, a harness, and a braking and steering_ system and, in specific embodiments, thrusters, all suspended from a single rail, which allows a human being to soar in simulated flight that is_safe, sustained, and suitable for all skill levels.

"For once you have tasted flight, you will walk the Earth with your eyes turned skyward, for there you have been, and there you long to return."

Leonardo Da Vinci

7 Claims, 18 Drawing Sheets

(56) References Cited

U.S. PATENT DOCUMENTS 5,094,171 A * 3/1992 Fujita ..... A62B 1/10 104/115
5,979,333 A * 11/1999 Houben ..... A63G 21/22 104/63
6,360,669 B1 * 3/2002 Albrich ..... B61B 12/02 104/173.1
7,966,941 B1 * 6/2011 Brannan ..... A63G 21/22 104/112
8,708,109 B2 * 4/2014 Steele ..... A63G 21/22 104/113
8,893,852 B2 * 11/2014 Liggett ..... A63B 35/0075 104/108
2002/0189488 A1 * 12/2002 Ostrobrod ..... A62B 35/0056 104/91
2005/0019736 A1 * 1/2005 Noll ..... G09B 19/0038 434/253
2006/0137563 A1 * 6/2006 Cummins ..... A63G 7/00 104/53
2008/0022881 A1 * 1/2008 Takasu ..... E01B 25/22 104/89
2008/0142644 A1 * 6/2008 O'Roark ..... B64C 39/026 244/4 A
2008/0202375 A1 * 8/2008 Quattlebaum ..... A63G 21/22 104/112
2009/0078148 A1 * 3/2009 Cylvick ..... A63G 7/00 104/53
2010/0147180 A1 * 6/2010 Perry ..... A63G 7/00 104/112
2011/0048274 A1 * 3/2011 Roodenburg ..... A63G 7/00 104/53
2011/0132224 A1 * 6/2011 Kitchen ..... A63G 1/28 104/53
2011/0133037 A1 * 6/2011 Martin ..... B64C 15/02 244/4 A
2012/0153088 A1 * 6/2012 Lokeberg ..... B64D 17/30 244/4 A
2012/0312186 A1 * 12/2012 Shasha ..... A63G 1/30 104/93
2014/0096699 A1 * 4/2014 Kitchen ..... A63G 7/00 104/53

* cited by examiner

HUMAN FLYING APPARATUS

CROSS REFERENCE TO RELATED APPLICATIONS

This application relates to, claims the benefit of and priority from, co-pending U.S. patent application Ser. No. 14/552,112, filed Nov. 24, 2014, of the same title and by the same inventor, the disclosure of which is incorporated herein by reference as if set forth in full.

TECHNICAL FIELD

This disclosure relates generally to amusement apparatuses, and more particularly to an apparatus for human flight or gliding suitable for use at a theme park, amusement park or other appropriate divertissement.

BACKGROUND

Human beings cannot fly. When we try in sports like sky diving, base-jumping, and bungee-jumping, we risk our lives.

Zip lines attempt to provide soaring, but the participant has little or no control, and the ride is over in just a few seconds. One must apply to several lines in a very large outdoor setting to get any air-time.

Indoor skydiving involves balancing on a column of super accelerated air that is uncomfortable at best. Again the ride only lasts a few seconds, and is not for all skill levels.

The aforementioned efforts to simulate a flying experience for humans are evidence of an unmet demand for a true experience of flying that is safe, comfortable, and that lasts a satisfying amount of time.

SUMMARY

A single rail system, suspended from the ceiling of a large warehouse, for example, shaped like an inverted roller coaster. Alternatively, the rail system is suspended from support members that extend upward from the ground. Integrated into the rail system is a free-moving, gravity driven wheel carriage which is attached to a bungee cord approximately 10 feet long, which is in turn attached to a soaring harness that a person wears to fly through this inverted course. The harness is equipped with a braking and steering system. It is essentially safe, indoor, flying for all ages and athletic abilities.

The apparatus of the present disclosure allows the participant to step off a platform into thin air, yet stay connected to the undulating course of the rail system. The flyer maintains a constant distance from the rail system, with some give in the bungee cord, and uses the harness and handlebar steering and braking system to glide and soar like a bird. It allows for courses that could last for many minutes at a time depending on the grade and height of the course. There is also the potential to run multiple flyers on multiple courses at staggered start times.

BRIEF DESCRIPTION OF THE DRAWINGS

For a more complete understanding of the present disclosure, and the advantages thereof, reference is now made to the following descriptions taken in conjunction with the accompanying drawings, in which.

NOTATION AND NOMENCLATURE

Figure 1A:
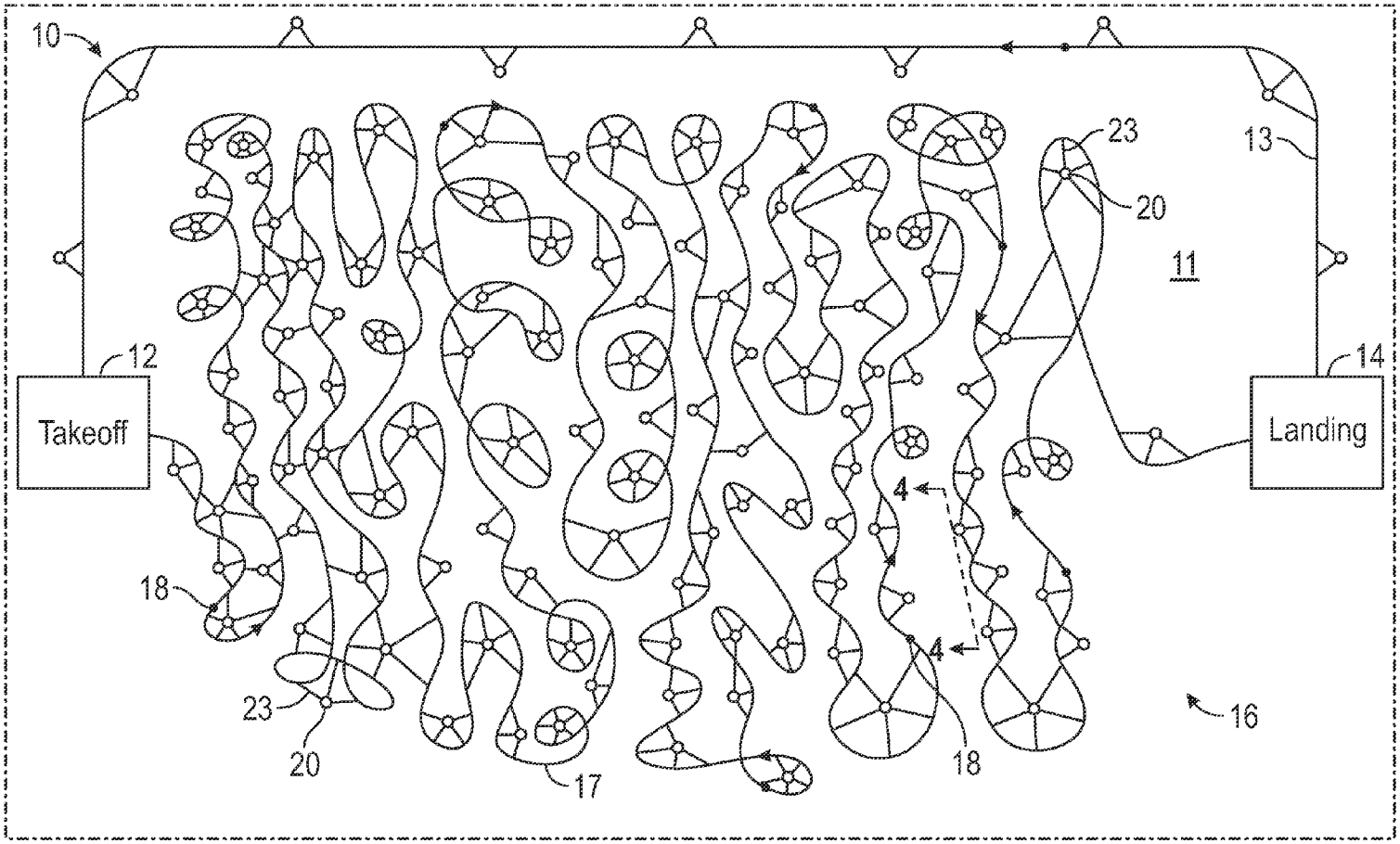
FIG. 1A is an elevated view diagrammatic illustration of a flying course with ground supports of the present disclosure.

Certain terms are used throughout the following description and claims to refer to particular system components. As one skilled in the art will appreciate, different companies may refer to a component by different names. This document does not intend to distinguish between components that differ in name but not function.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples to a second device, that connection may be through a direct connection or through an indirect connection via other devices and connections.

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

For convenient reference a list of the drawing reference numbers correlated to the elements to which they refer is provided.

DESCRIPTION LIST

10: designates a simulated flight system of the present disclosure.
11: designates the building or area that houses the system.
12: designates the elevated takeoff station.
13: designates the return rail.
14: designates the lower landing station.
16: designates the undulating, downward trending rail system.
17: designates the rail.
18: designates the carriage.
19: designates the optional ceiling suspension members of building 11.
20: designates the suspension members of rail system 16.
21: designates the safety net.
22: designates the bungee cord.
23: designates the support struts.
24: designates the adjustable handlebar and brake assembly.
25: designates the guide wires.
26: designates the user.
27: designates the safety slack cord.
28: designates the harness.
30: designates the attachment and stabilizing panel.
32: designates the wings.
33: designates the tail section of wings.
34: designates the adjustable weighted handlebar.
35: designates the handlebar brake levers.
36: designates the wheels.
38: designates the brake pads.
39: designates the support pipe.
40: designates the bend in support pipe 39.
41: designates the support pipe pivot ball.
42: designates the support pipe clamp for bungee cord 22.
44: designates the block.
46: designates the brake line conduit.
47: designates the brake lines.
48: designates the axle housing.
50: designates the axle.
52: designates the handlebar frame and brake line conduit 52.
54: designates the broom fuselage.
55: designates the accordion joint attachment.
56: designates the seat.
58: designates the footrest.
60: designates the hip safety bar.
62: designates the hip seat belt.
64: designates the lap seat belt.
66: designates the shoulder safety cord.
67: designates a thruster.
68: designates thruster control panel.
69: designates control panel connection to thrusters.

FIG. 1A of the drawings is an elevated view diagrammatic illustration of a flying course of the present disclosure. The reference numeral 10 generally designates an exemplary embodiment of a simulated flight system of the present disclosure embodying features of the present disclosure. The system 10 includes rail system 16 which preferably is installed in a building or on suitable terrain 11, which includes the floor of the building in certain exemplary enclosed embodiments, but also contemplates open air or enclosed exemplary embodiments wherein terrain 11 may be any one of a variety of suitable surfaces such as earth, turf, asphalt, concrete, synthetic surface and so forth. In the following description, reference number 11 is used to refer all such exemplary installation embodiments interchangeably.

Rail system 16 provides rail 17 which descends at an incline from elevated takeoff station 12 and terminates at landing station 14, which landing station 14 is at a lower elevation than takeoff station 12. Return rail 13 connects landing station 14 to takeoff station 12 to form a rail loop. Rail 17 is preferably modularly configurable so that it can be changed to provide a variety of desired flight paths.

Carriage 18 is movably mounted to or housed in rail 17 so that, upon departing take-off station 12, carriage 18 descends along rail 17 until it lands at landing station 14. The direction of travel of carriage 18 along rail 17 is indicated by bold directional arrows in the drawings.

Figure 1B:
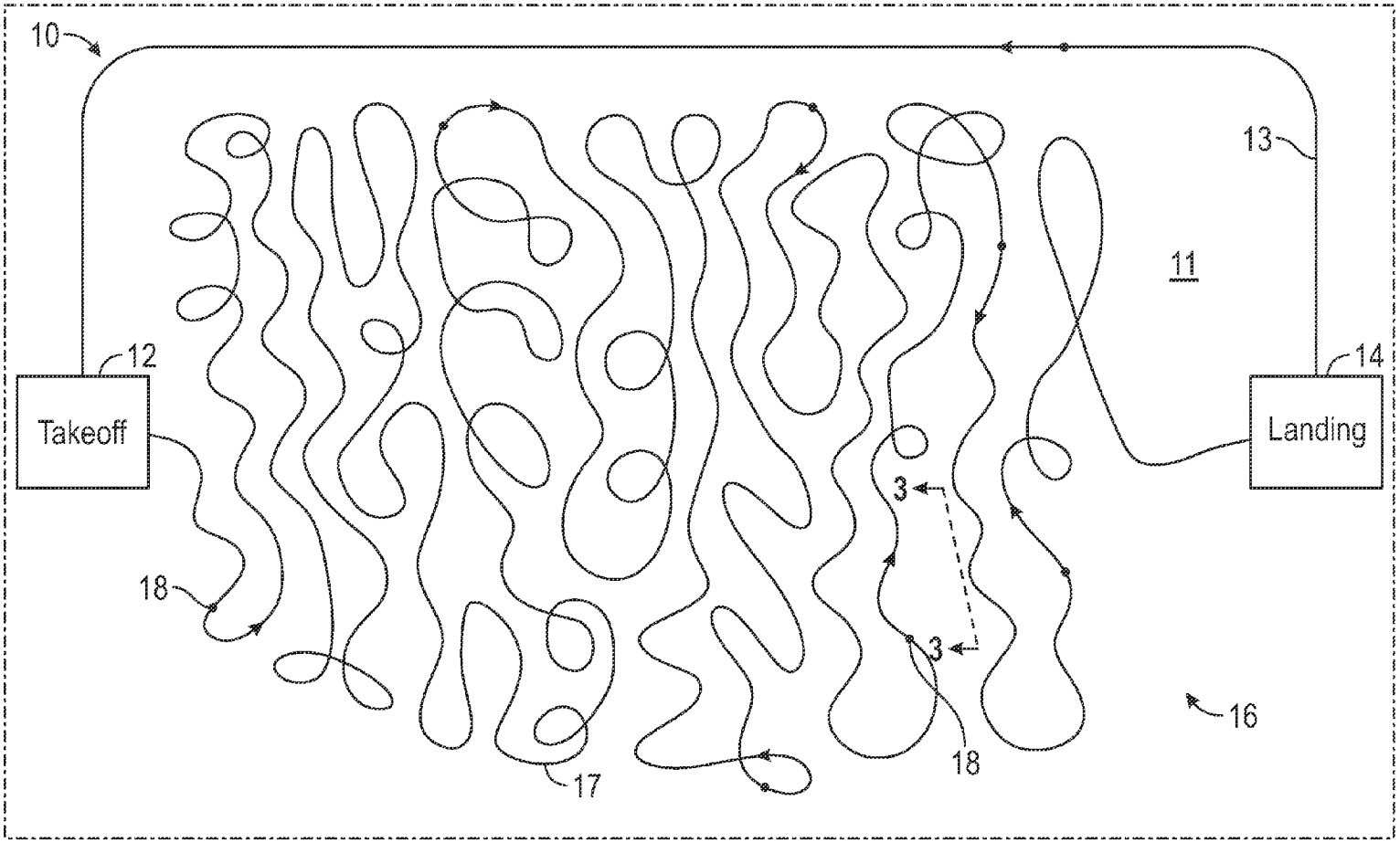
FIG. 1B is an elevated view diagrammatic illustration of a flying course with ceiling suspension supports of the present disclosure.

FIG. 1B is an elevated view diagrammatic illustration of an alternative embodiment of a flying course 10 such as in FIG. 1A, wherein rail 17 is suspended from the ceiling of a course housing 11 such that support members 20 and support struts 23 depend from the ceiling of housing 11. This is in contrast to the arrangement of FIG. 1A, where support members 20 are anchored to the ground and support struts 23 depend from the top of members 20 (see FIG. 2B).

Figure 2A:
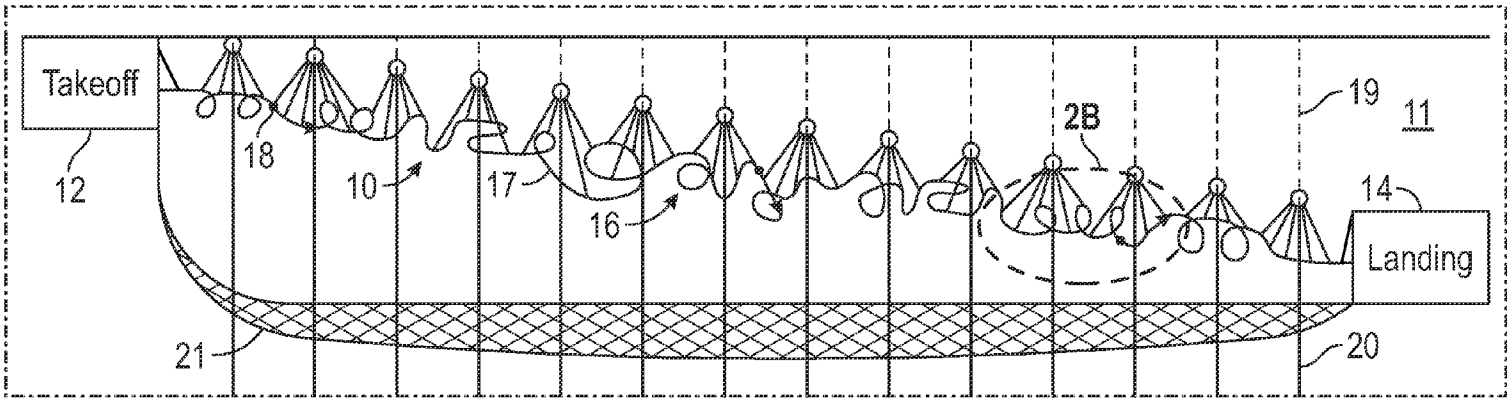
FIG. 2A is a side view diagrammatic illustration of the flying course of FIG. 1A.

Turning now to FIG. 2A, FIG. 2A is a side view diagrammatic illustration of the flying course of FIG. 1A. The present disclosure contemplates a variety of embodiments for erecting and securing rail system 16. One exemplary embodiment provides rail system 16 erected vertically on terrain 11 with, for example, scaffolding or other suitably sturdy vertical support members. In other exemplary embodiments, particularly enclosed embodiments, rail system 16 is suspended from the ceiling of an enclosure for system 16 with suitably strong suspension members 20. In still other exemplary embodiments, a combination of floor support members extending upward from terrain 11 and suspension members descending from the roof of an enclosure are utilized to safely secure rail system 16.

In a specific exemplary embodiment, a plurality of upright suspension members 20, each one of the plurality having a foot and a top, are installed at their respective feet on terrain 11. A plurality of suspension struts 23 hang from the top of each of the plurality of suspension member 20 and are connected to rail 17 at various points along the path of rail 17. One or more additional suspension members 19 are optionally provided in alternative exemplary embodiments. Safety net 21, disposed under rail 17, is particularly useful for embodiments in which rail system 16 is suspended from the ceiling of a housing.

Suspension struts 23 are preferably attached to rail 17 vertically in such a way that the path of rail 17 includes a variety of forms of loop de loops, for example, and other entertaining flight paths. Additionally, the plurality of suspension members 20 is disposed around terrain 11 horizontally to provide lateral displacement of the flight path for enhanced entertainment value. By arranging the vertical and horizontal elements of rail 17, an entertaining ride is provided in which carriage 18 descends from takeoff station 12 and follows a wild, careening, path along rail 17, terminating at landing station 14. Due to its large scale, simulated flight system 10 is preferably installed as a permanent attraction. However, specific alternative embodiments provide the plurality of suspension members and suspension struts in a modular form so that the flight paths can be changed periodically or so that system 10 can be relocated to a different site.

Figure 2B:
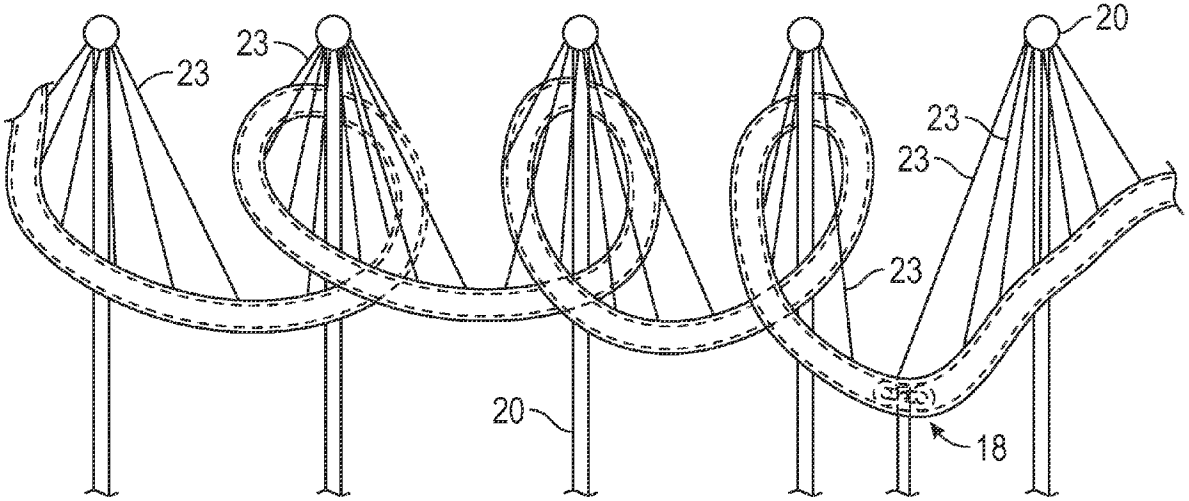
FIG. 2B is an elevated side view diagrammatic illustration of a detail of the flying course taken on line 4-4 of FIG. 1A.

FIG. 2B is an elevated side view diagrammatic illustration of a detail of the flying course taken on line 4-4 of FIG. 1B. Rail 17 is shown looping around suspension members 20 by virtue of the plurality of suspension struts radiating in all the directions around the top of each suspension member 20.

Figure 2C:
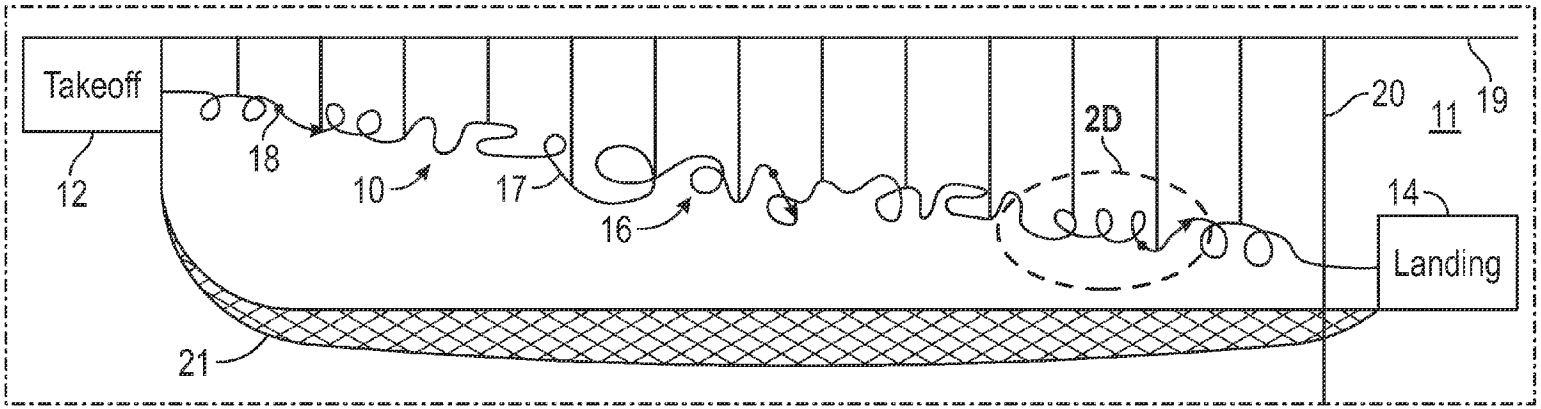
FIG. 2C is a side view diagrammatic illustration of the flying course of FIG. 1B.
Figure 2D:
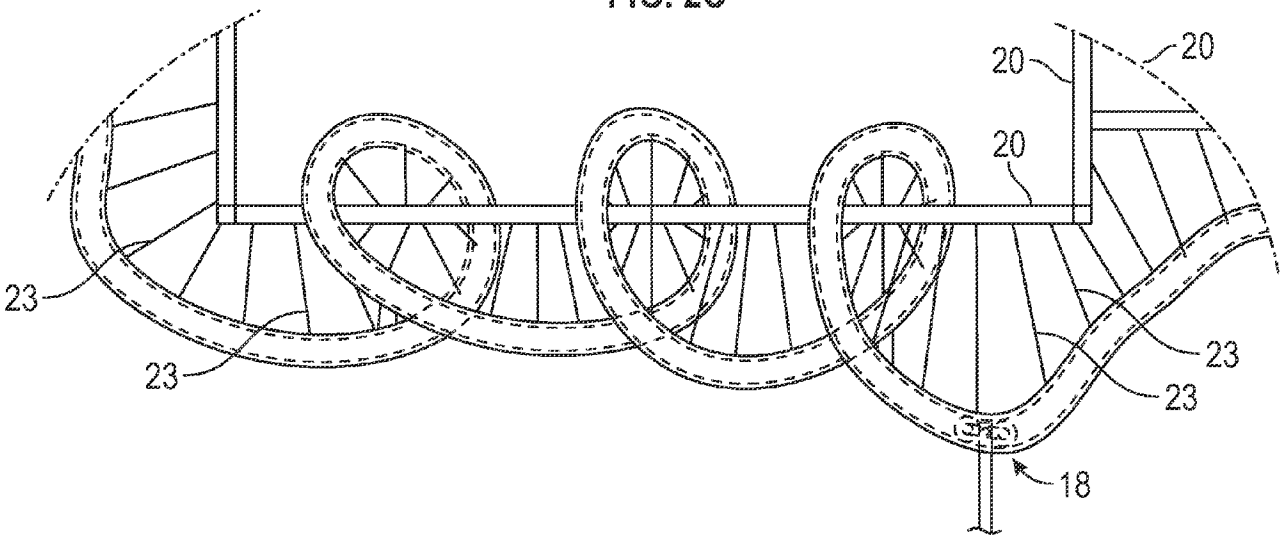
FIG. 2D is an elevated side view diagrammatic illustration of a detail of the flying course taken on line 3-3 of FIG. 1B.

FIG. 2C is a side view diagrammatic illustration of the flying course of FIG. 1B.

FIG. 2B is an elevated side view diagrammatic illustration of a detail of the flying course taken on line 3-3 of FIG. 2C.

Figure 3:
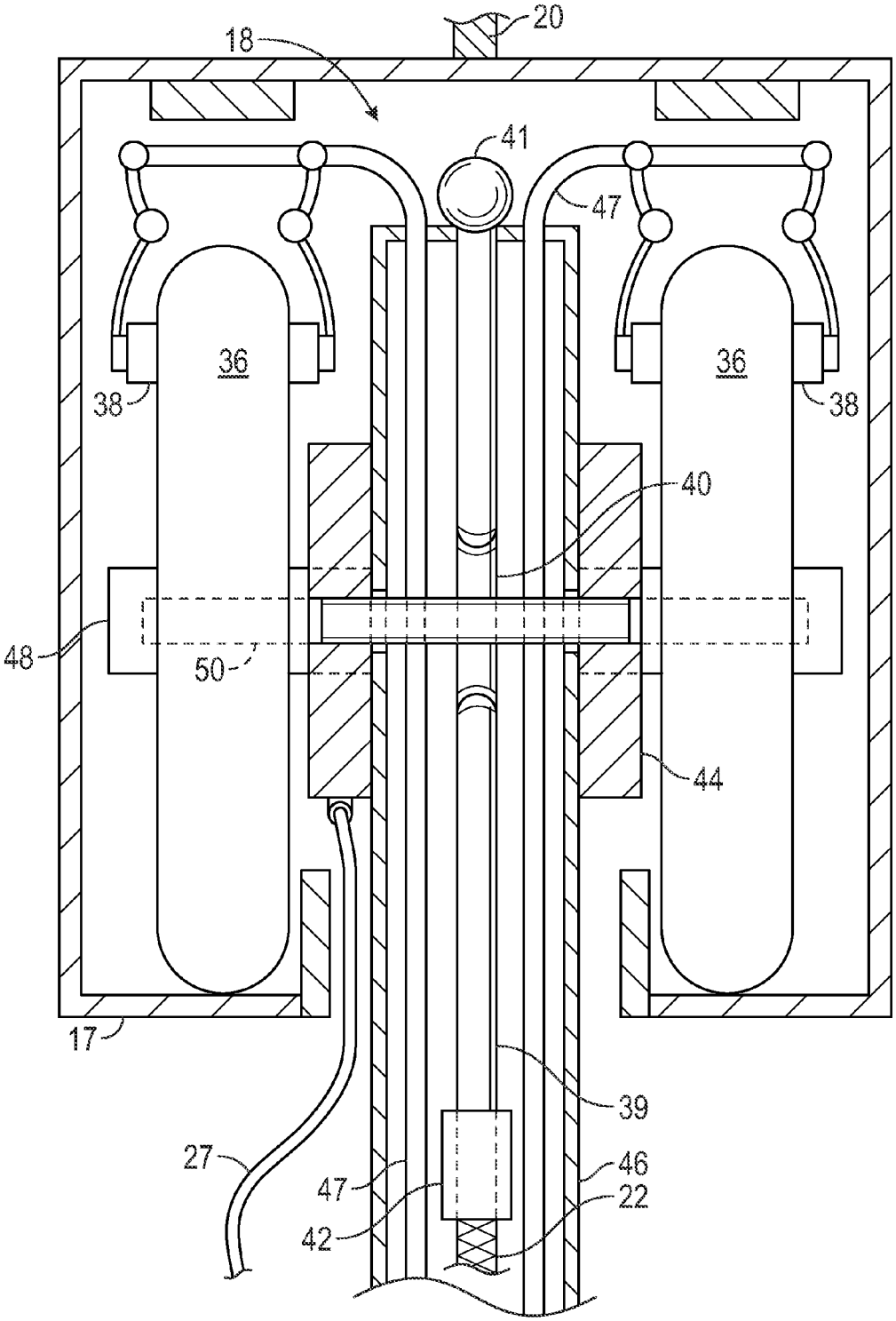
FIG. 3 is a side elevation view of an alternative exemplary embodiment of a harness of the present disclosure.
Figure 4:
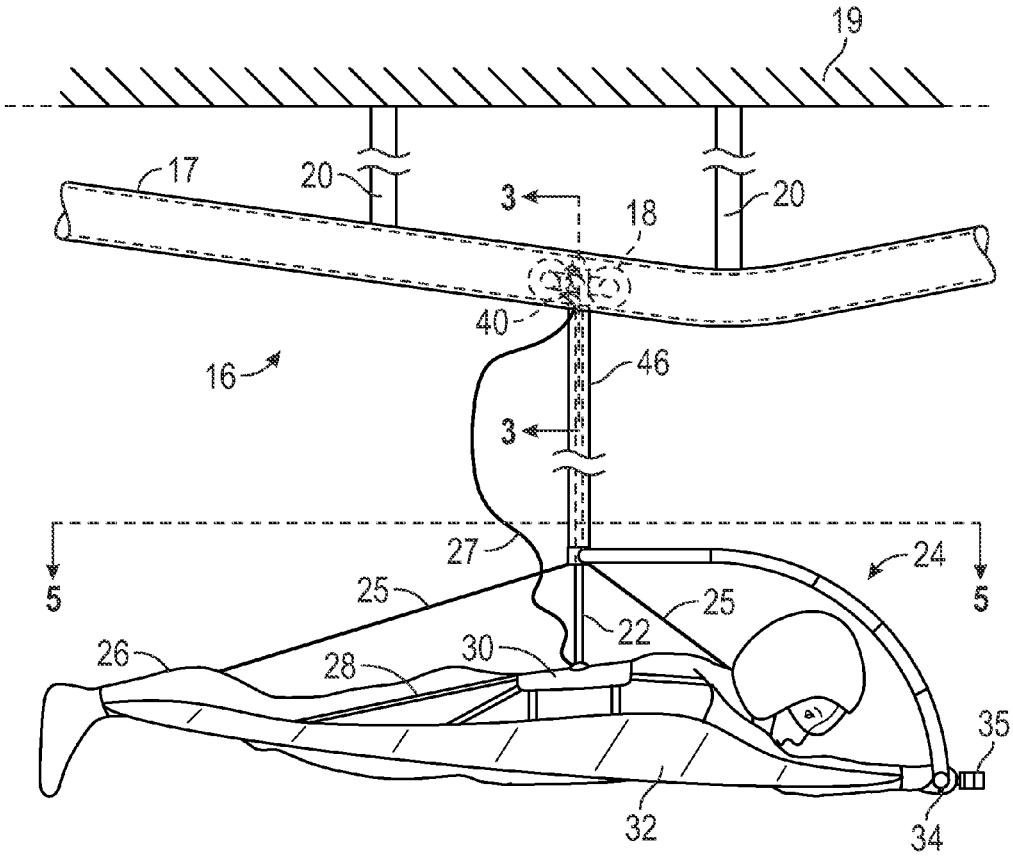
FIG. 4 is a side elevation view of a specific alternative embodiment of the embodiment of FIG. 3.

FIG. 3 is a top plan cross-sectional view of a harness of the present disclosure taken on line 3-3 of FIG. 4. Carriage 18 is depicted housed in rail 17 on support pipe 46 and carriage 18 consists of an assembly that includes a pair of wheels 36 wherein one wheel of the pair of wheels 36 is disposed on one side of support pipe 39 and the other wheel of the pair of wheels 36 is disposed on the other side of support pipe 39. The wheels of the pair of wheels 36 are rotate-ably connected to each other by axle 50 which is at least partially housed in axle housing 48. Support pipe 39 provides bend 40 to accommodate the traverse of axle 50. Support pipe 39 terminates at its proximate end at support ball 41. In specific alternative embodiments support ball 41 is pivot-able to allow carriage 17 to swing on support pipe 39.

Continuing with the description of the carriage 18 assembly, brake pads 38 selectively engage the pair of wheels 36 via actuation of brake lines 47. Support pipe clamp 42 for bungee cord 22 is mounted on the distal end of support pipe 39. Block 44 is mounted on the exterior of brake line conduit 46 inside rail 17 and safety slack cord 27 is fastened to block 44.

Figure 5:
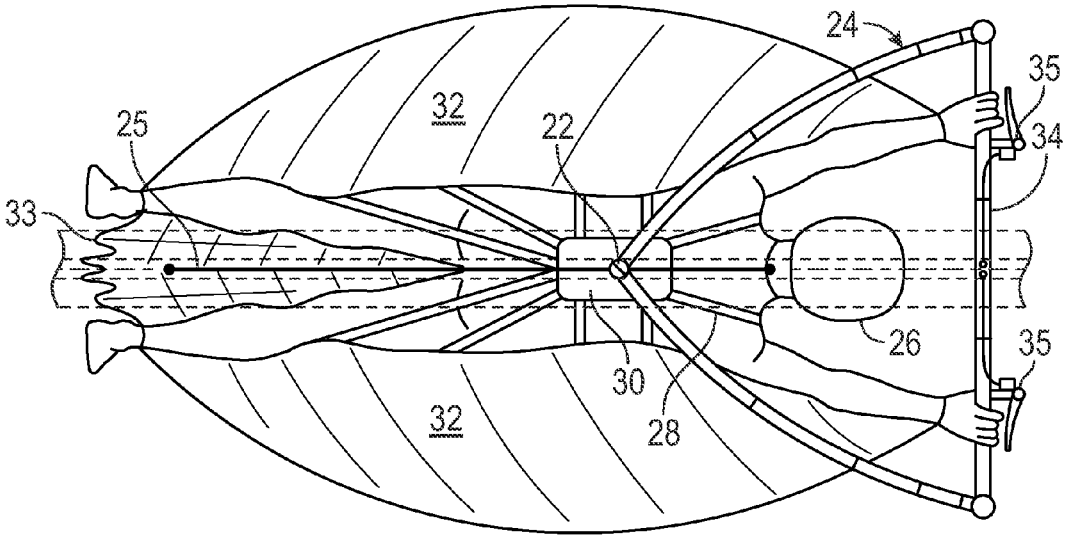
FIG. 5 is a top plan view of a specific alternative embodiment of the embodiment of FIG. 4.

FIG. 4 is a side elevation view indicated by line 4-4 of FIG. 1A. FIG. 5 is a top plan view taken on line 5-5 of FIG. 4. FIGS. 4 and 5 are discussed below together.

FIGS. 4 and 5 depict a specific exemplary embodiment of a flying apparatus with wings of the present disclosure mounted to and suspended from carriage 18 by brake line conduit 46. The mount arrangement allows user 26 to engage carriage 18 via a manually operated brake line to slow down or stop carriage 18. Depending from brake line conduit 46 is elastic member 22, such as a bungee cord, which is attached distally to attachment and stabilizing panel 30 of the apparatus, or, with particular specific harnesses, is connected distally to accordion joint 55. A first adjustable handlebar and brake assembly 24 is also connected to brake line conduit 46 and also provides a brake line conduit from the user's 26 hands to conduit 46 and ultimately to carriage 18.

First assembly 24 extends rearward and above user 26 from a first end of handlebar cross member 34. A second assembly 24 extends rearward and above user 26 from a second end of handlebar cross member 34 (see FIG. 5). A first hand brake assembly 35 is mounted to the first end of handlebar cross member 34 and a second hand brake assembly is mounted to the second end of handlebar 35. First and second hand brake assemblies 35 provide braking to carriage 18 via brake line conduits 24 and 46.

Guide wires 25 connect brake line conduit 46 to user 26 at a front end and to the harness at a rear end to provide stability. Safety slack cord 27 extends with slack from rail 17 to panel 30. Harness 28 provides a plurality of support members extending from panel 30 to wings 32.

Figure 6:
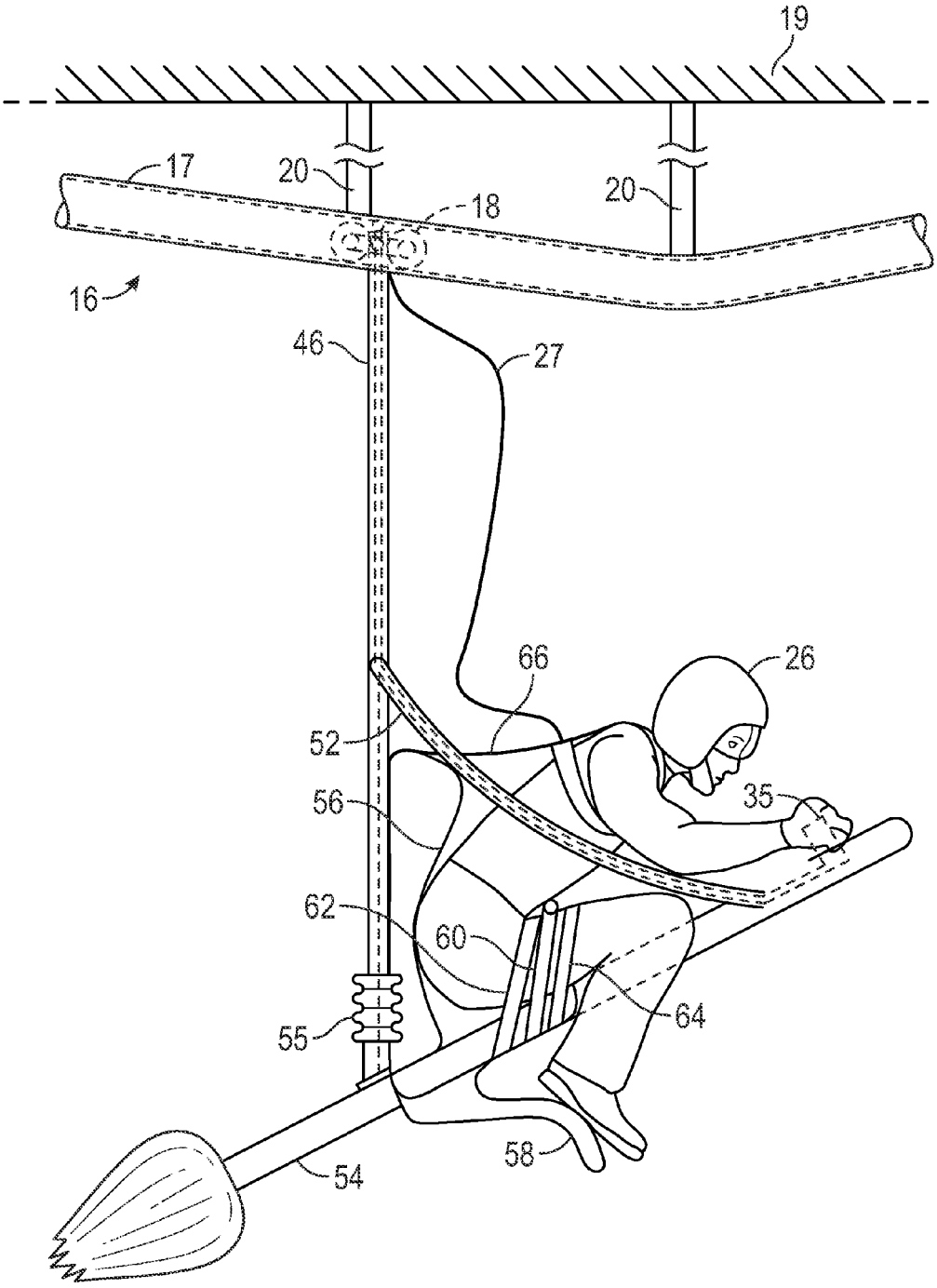
FIG. 6 is a side elevation view of an alternative exemplary embodiment of the embodiment of FIG. 4 depicting a flying broom harness.

FIG. 6 is a side elevation view of an alternative exemplary embodiment of the invention. The flying apparatus is the embodiment of FIG. 6 is a flying broom. Broom fuselage 54 has a top and a bottom and is suspended to brake line conduit 46 from the top via accordion joint attachment 55. Handlebar frame and brake line conduit 52 connects to and communicates with conduit 46 and houses a manually operated brake line that communicates with carriage 18 via conduit 46. Seat 56 is mounted on the top of fuselage 54 in front of conduit 46. Footrest 58 is mounted to the bottom of fuselage 54 opposite seat 56. Hip safety bar 60 is mounted to fuselage 54 and extends upward to secure user 26 in seat 56. Hip seat belt 62 is attached to fuselage 54 and wraps around the waist of user 26. Lap seat belt 64 is attached to fuselage 54 and wraps around the legs of user 26. Shoulder safety cord 66 extends between and connects user 26 to seat 56.

Alternative embodiments provide pneumatic thrusters 67 to provide forward or directional thrust for more speed and enhanced steering.

Figure 7:
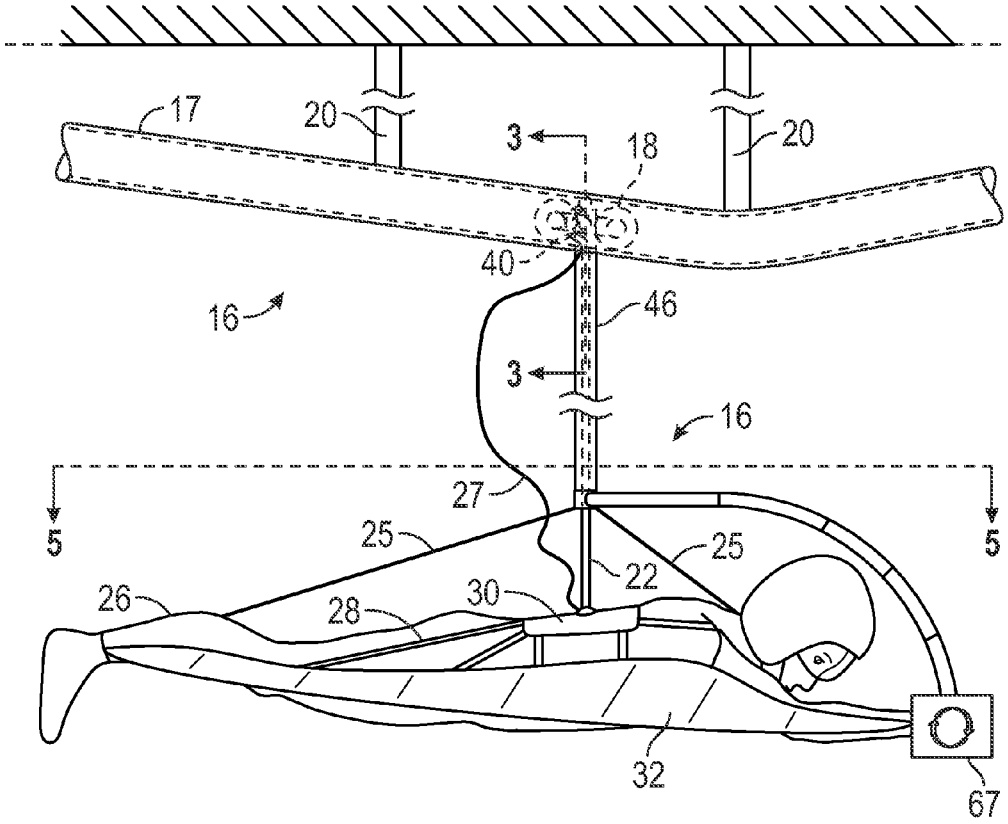
FIG. 7 is a side elevation view of an alternative exemplary embodiment of the embodiment of FIG. 4 having one or more thrusters.
Figure 8:
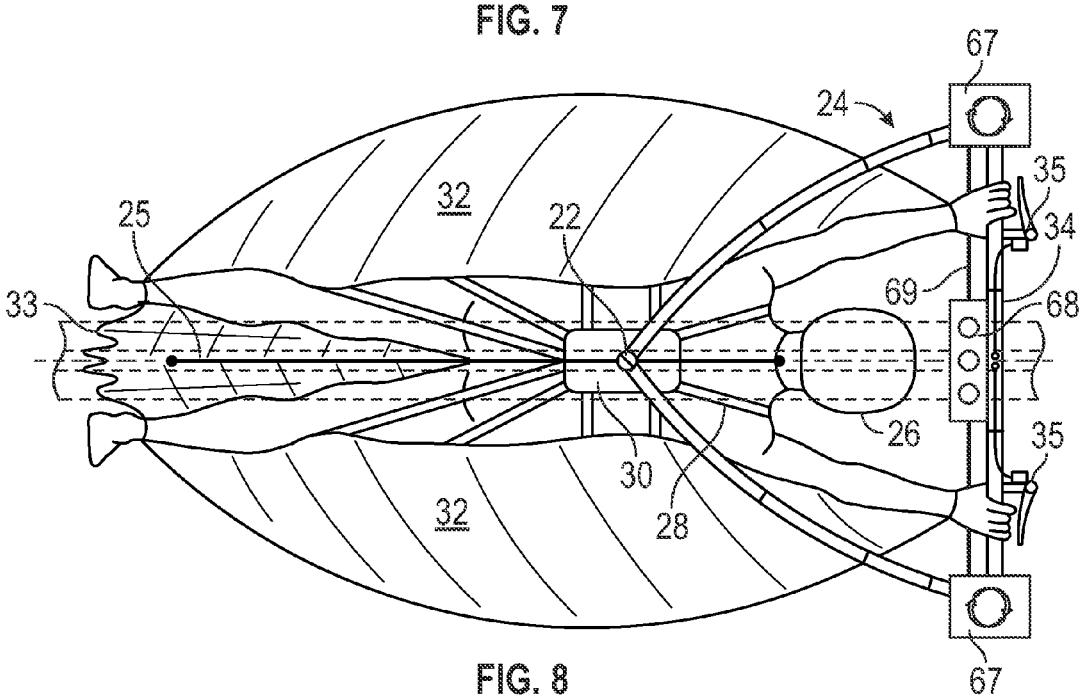
FIG. 8 is a top plan view of an alternative exemplary embodiment of the embodiment of FIG. 7.

FIG. 7 is a side elevation view of a specific alternative embodiment of the embodiment of FIG. 4. FIG. 8 is a top plan view of a specific alternative embodiment of the embodiment of FIG. 5. FIGS. 7 and 8 are discussed herein together. In the alternative embodiment of FIGS. 7 and 8, one or more thruster 67 is pivotally mounted to handlebar 34 to provide optional forward thrusting force for increased speed. Steering is enhanced by pivoting thruster 67 to change the direction of thrust using control panel 68 on handlebar 34. Control panel 68 connects to thrusters 67 with connection 69.

Figure 9:
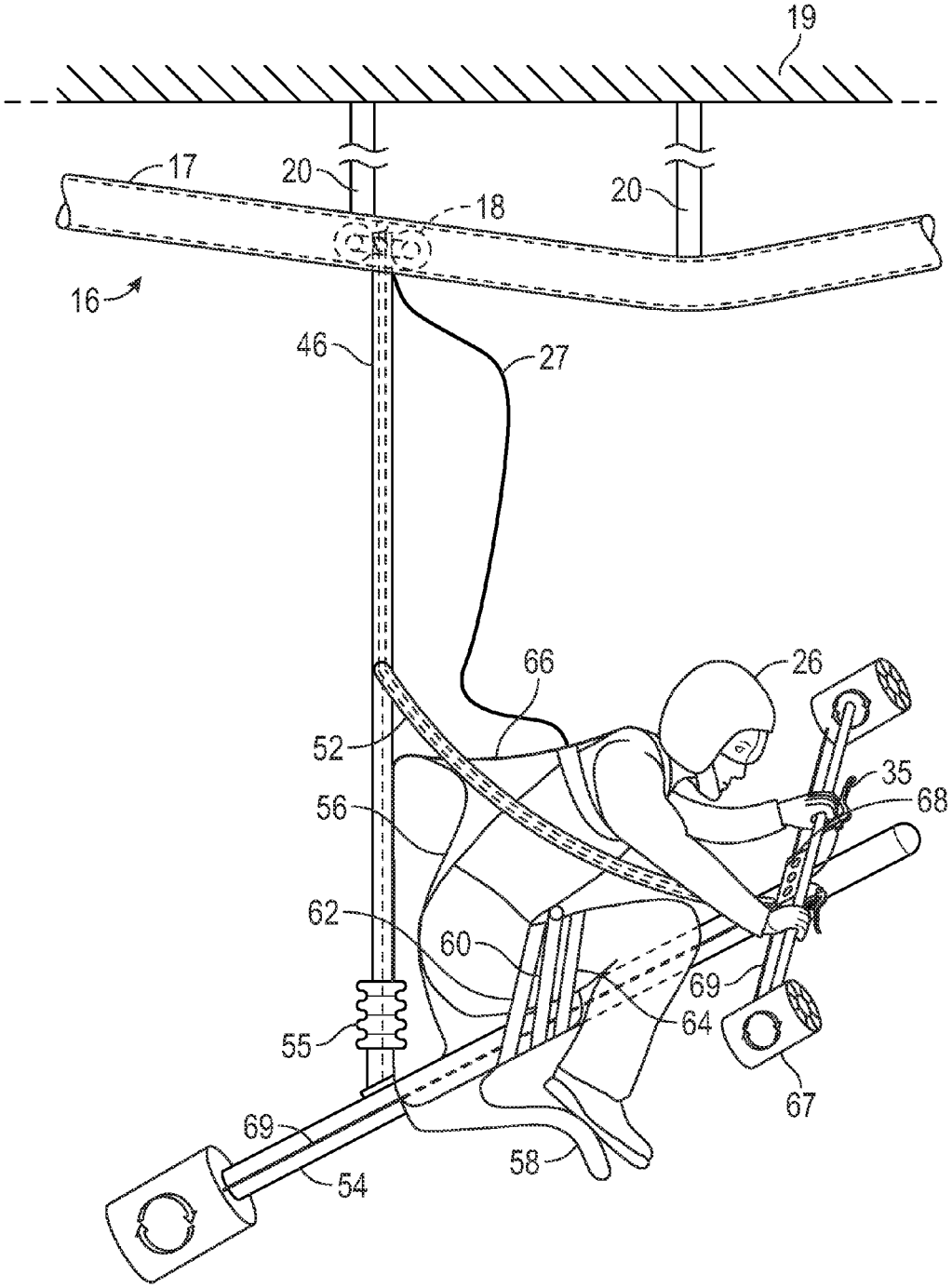
FIG. 9 is a side elevation view of an alternative exemplary embodiment of the embodiment of FIG. 6 having one or more thrusters.

FIG. 9 is a side elevation view of an alternative exemplary embodiment of the embodiment of FIG. 6. In the alternative embodiment of FIG. 9, handle bar 24 is proximally mounted to fuselage 54, and one or more thruster 67 is pivotally mounted to handlebar 24 as well as distally on fuselage 54 to provide optional forward thrusting force for increased speed. Steering is enhanced by pivoting thruster 67 to change the direction of thrust.

The decorative and entertaining design of harnesses for a simulated flying system 10 of the present disclosure is limited only by the imagination. Examples of decorative and entertaining harnesses are provided in FIGS. 10-18.

Figure 10:
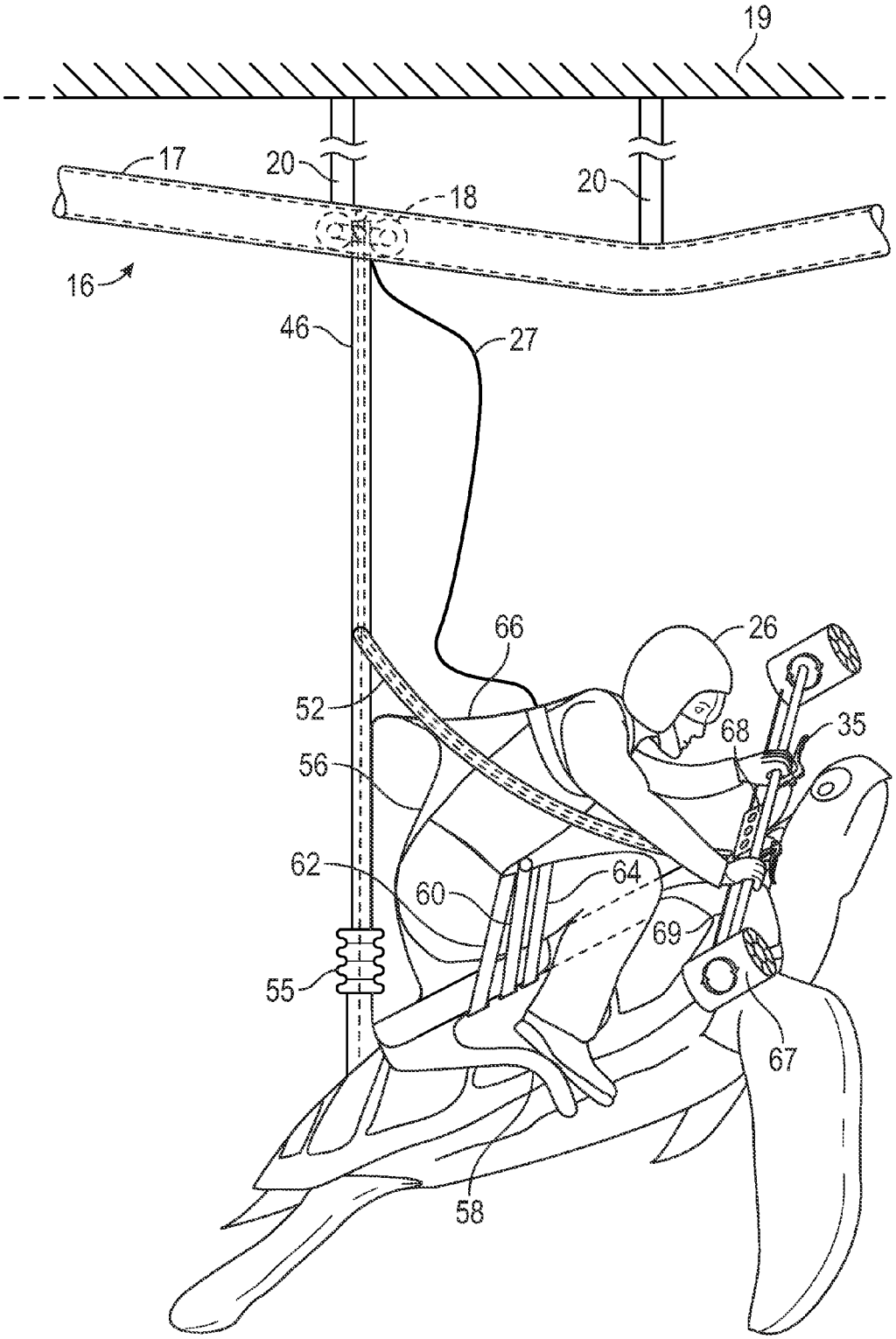
FIG. 10 is a diagrammatic illustration of an alternative sea turtle harness.

FIG. 10 is a diagrammatic illustration of an alternative sea turtle harness.

Figure 11:
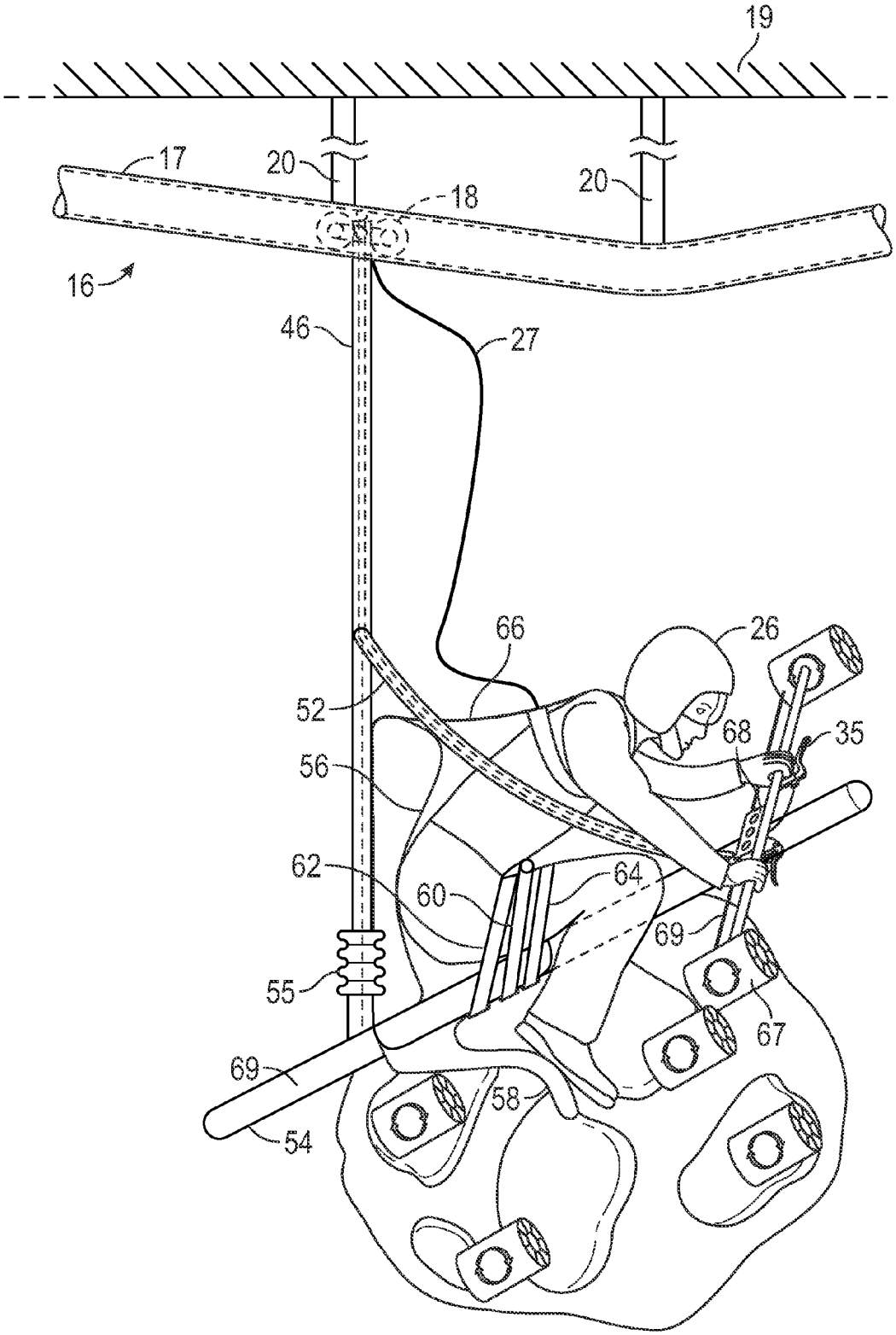
FIG. 11 is a diagrammatic illustration of an alternative comet harness. Related harnesses include planets and the moon.

FIG. 11 is a diagrammatic illustration of an alternative comet harness. Related harnesses include planets and the moon.

Figure 12:
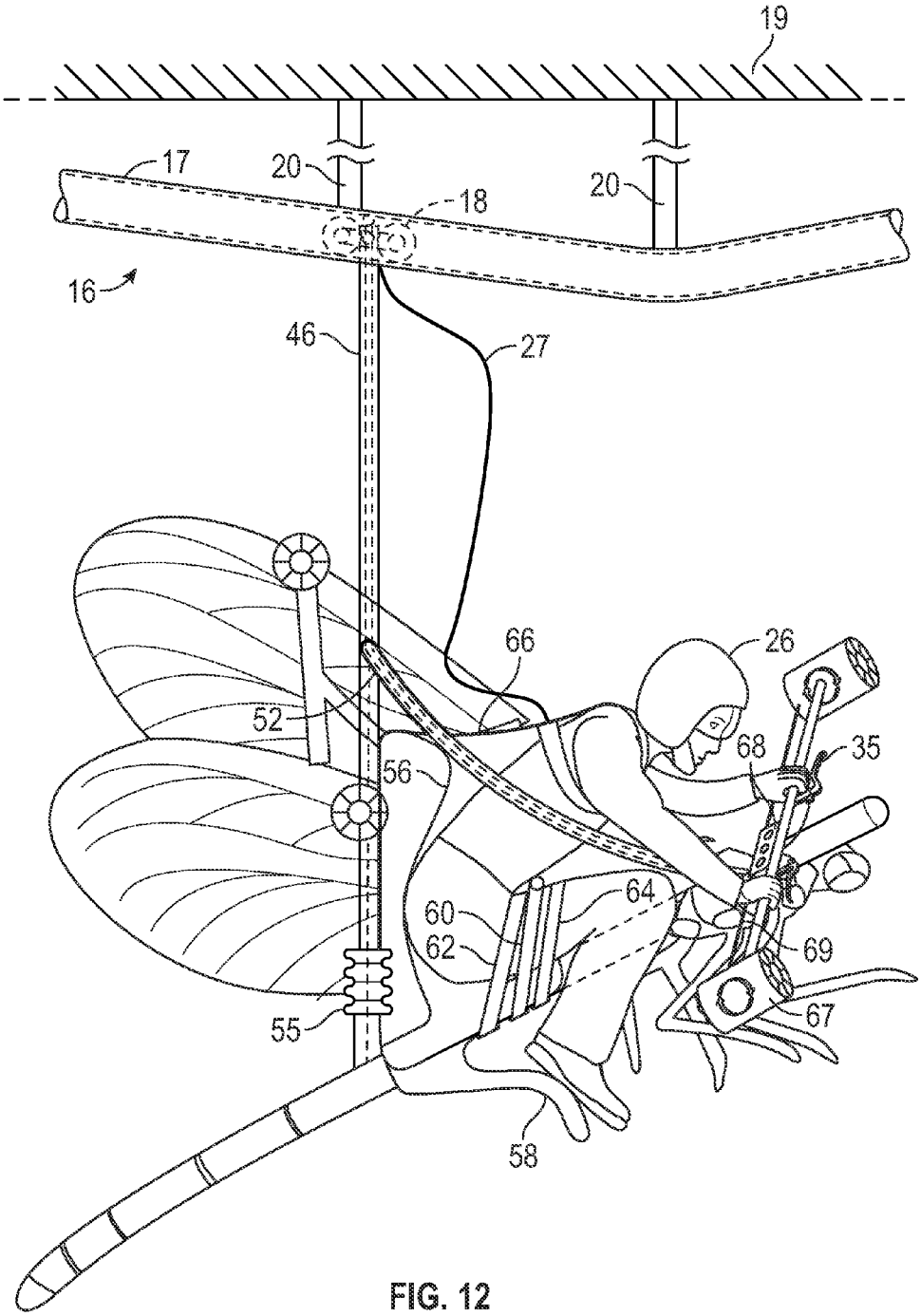
FIG. 12 is a diagrammatic illustration of an alternative insect harness, such as a dragon fly.

FIG. 12 is a diagrammatic illustration of an alternative insect harness, such as a dragon fly.

Figure 13:
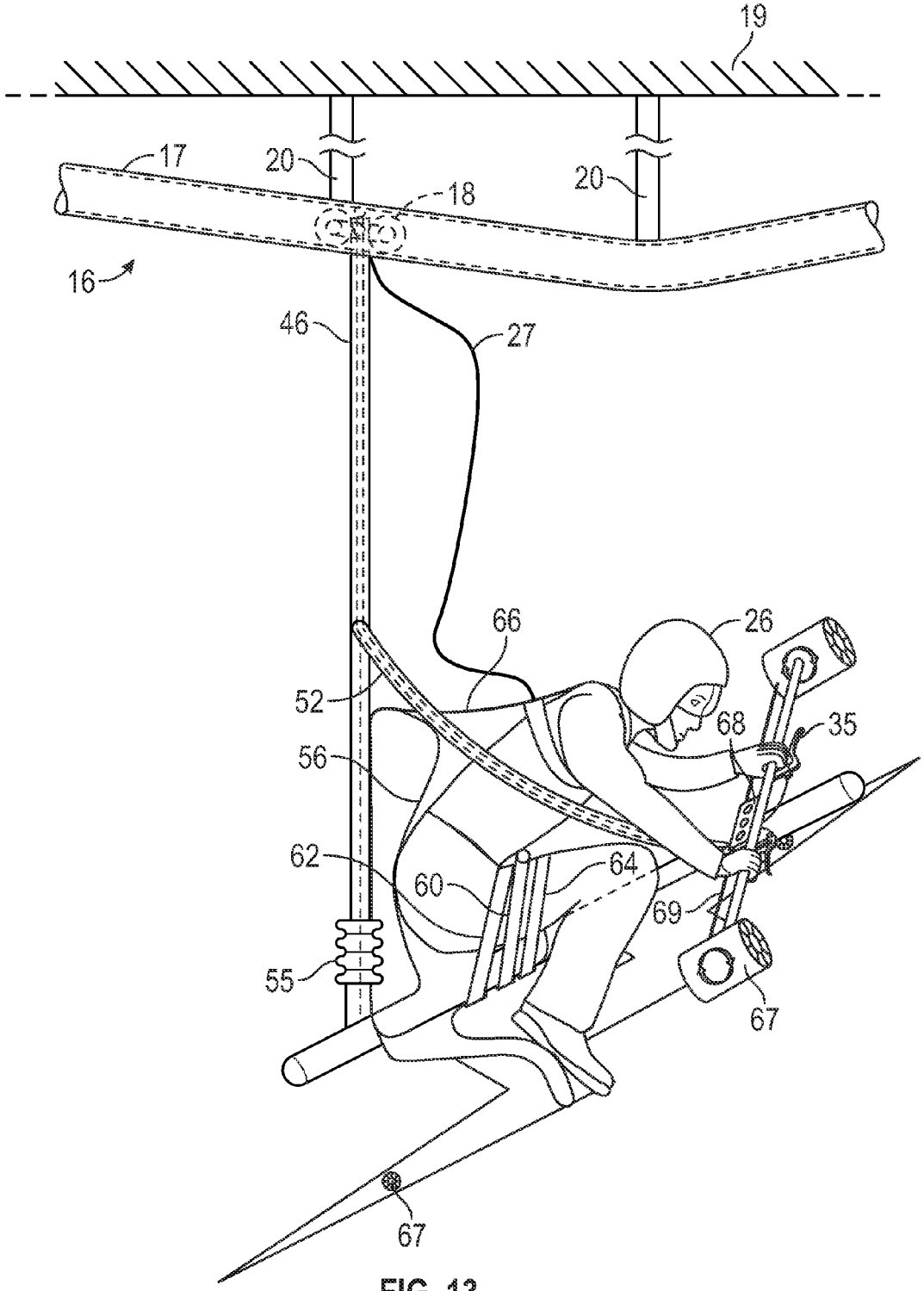
FIG. 13 is a diagrammatic illustration of an alternative lightning bolt harness.

FIG. 13 is a diagrammatic illustration of an alternative lightning bolt harness.

Figure 14:
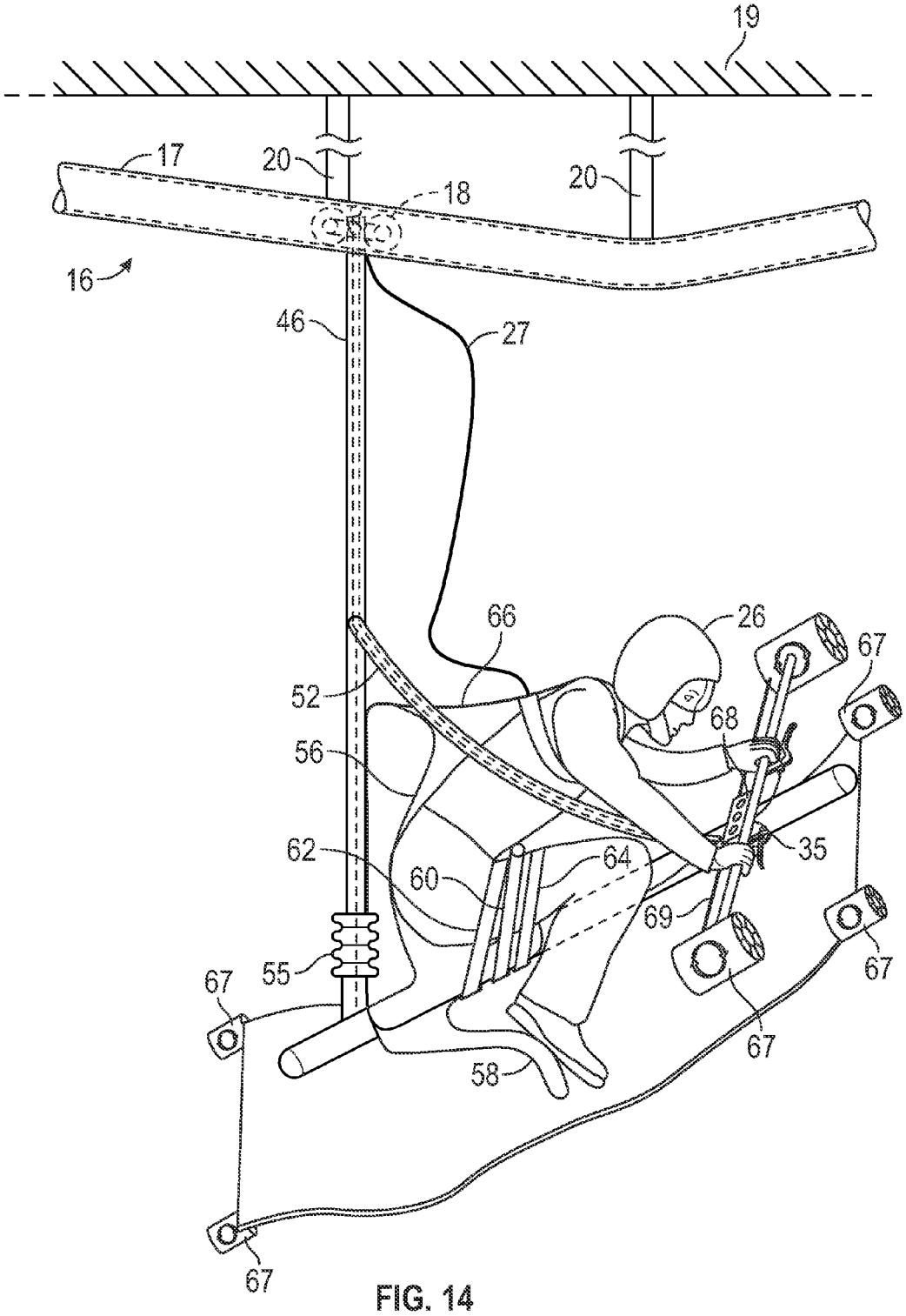
FIG. 14 is a diagrammatic illustration of an alternative flying carpet harness.

FIG. 14 is a diagrammatic illustration of an alternative flying carpet harness.

Figure 15:
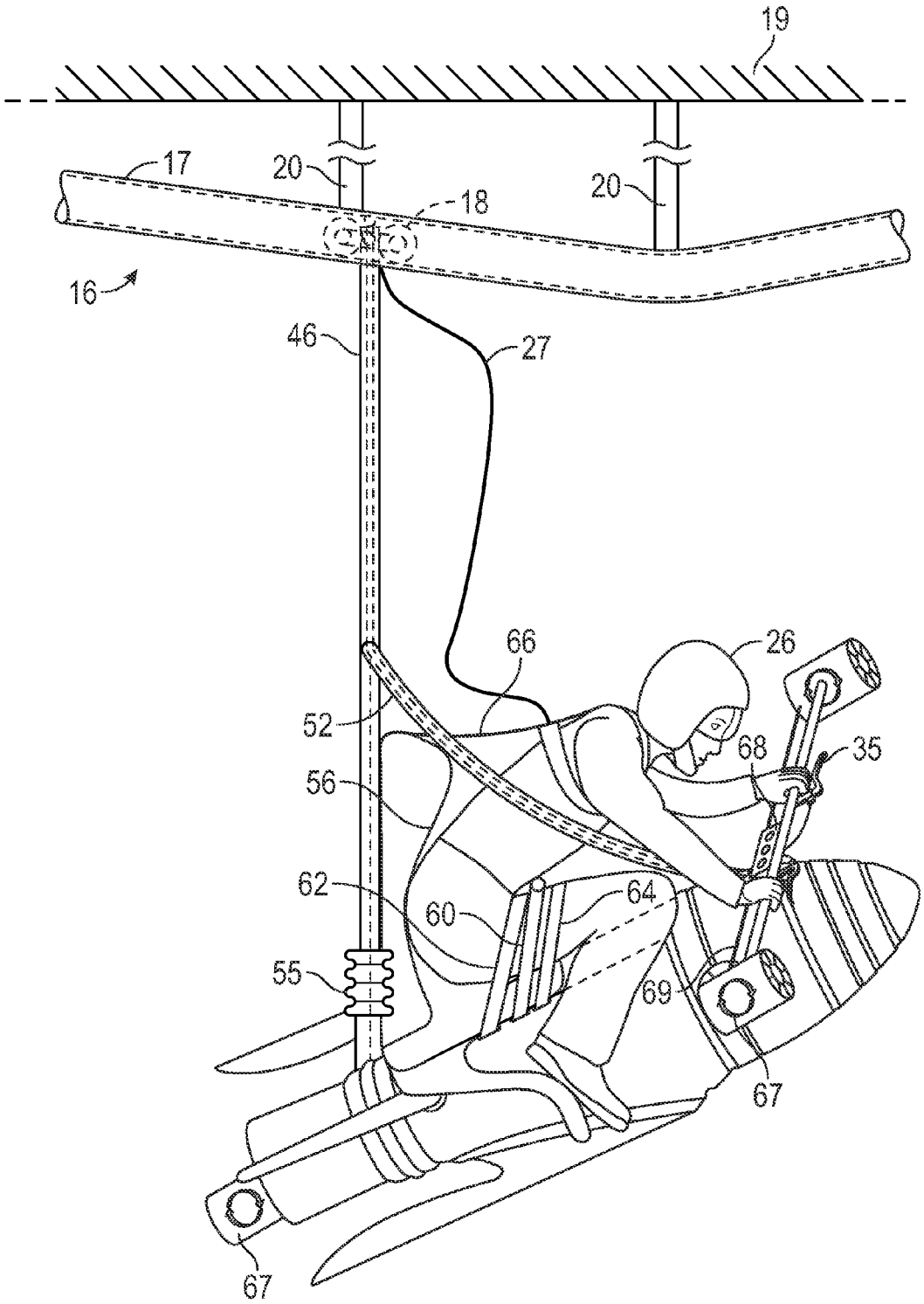
FIG. 15 is a diagrammatic illustration of an alternative space ship harness.

FIG. 15 is a diagrammatic illustration of an alternative space ship harness.

Figure 16:
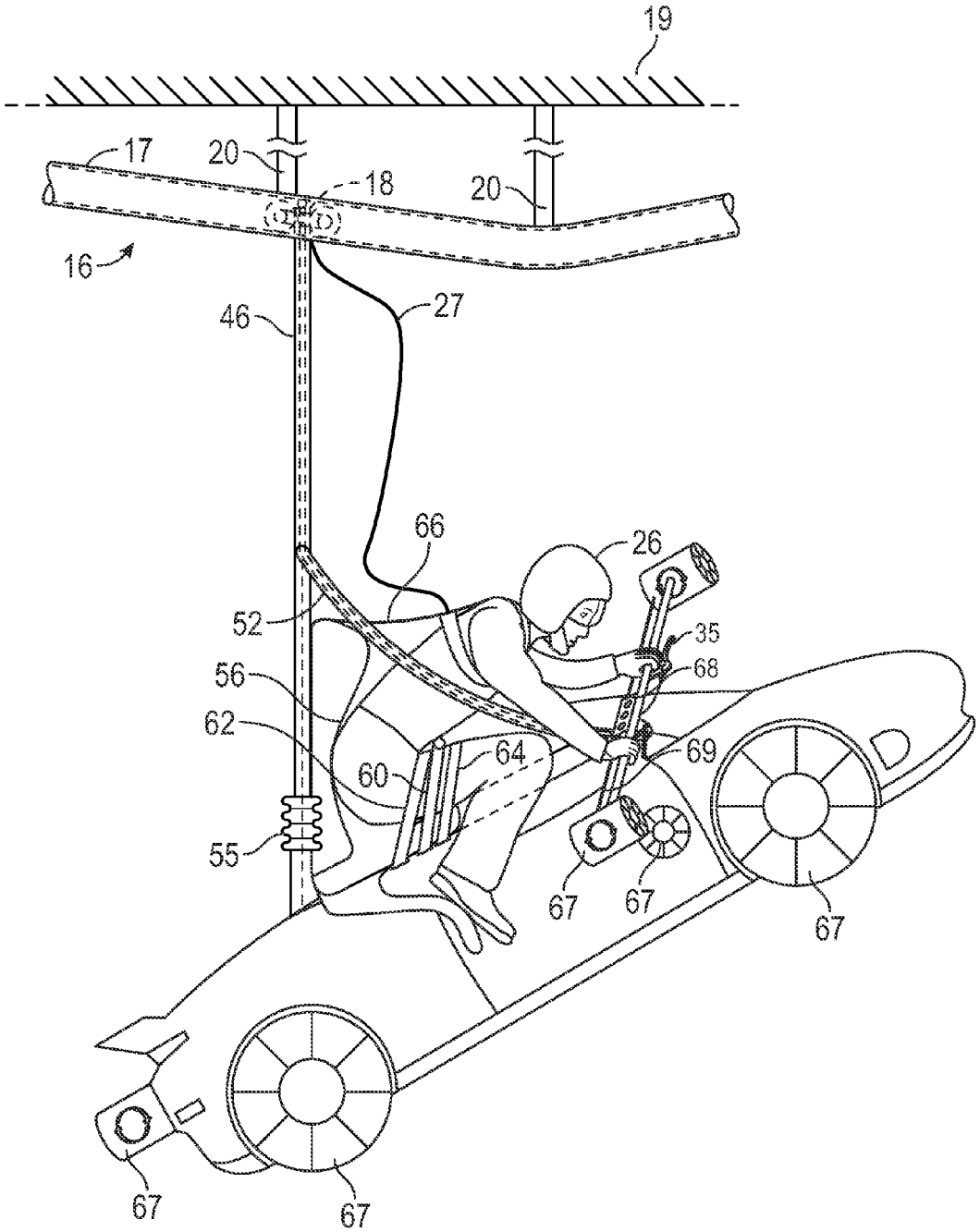
FIG. 16 is a diagrammatic illustration of an alternative race car harness.

FIG. 16 is a diagrammatic illustration of an alternative race car harness.

Figure 17:
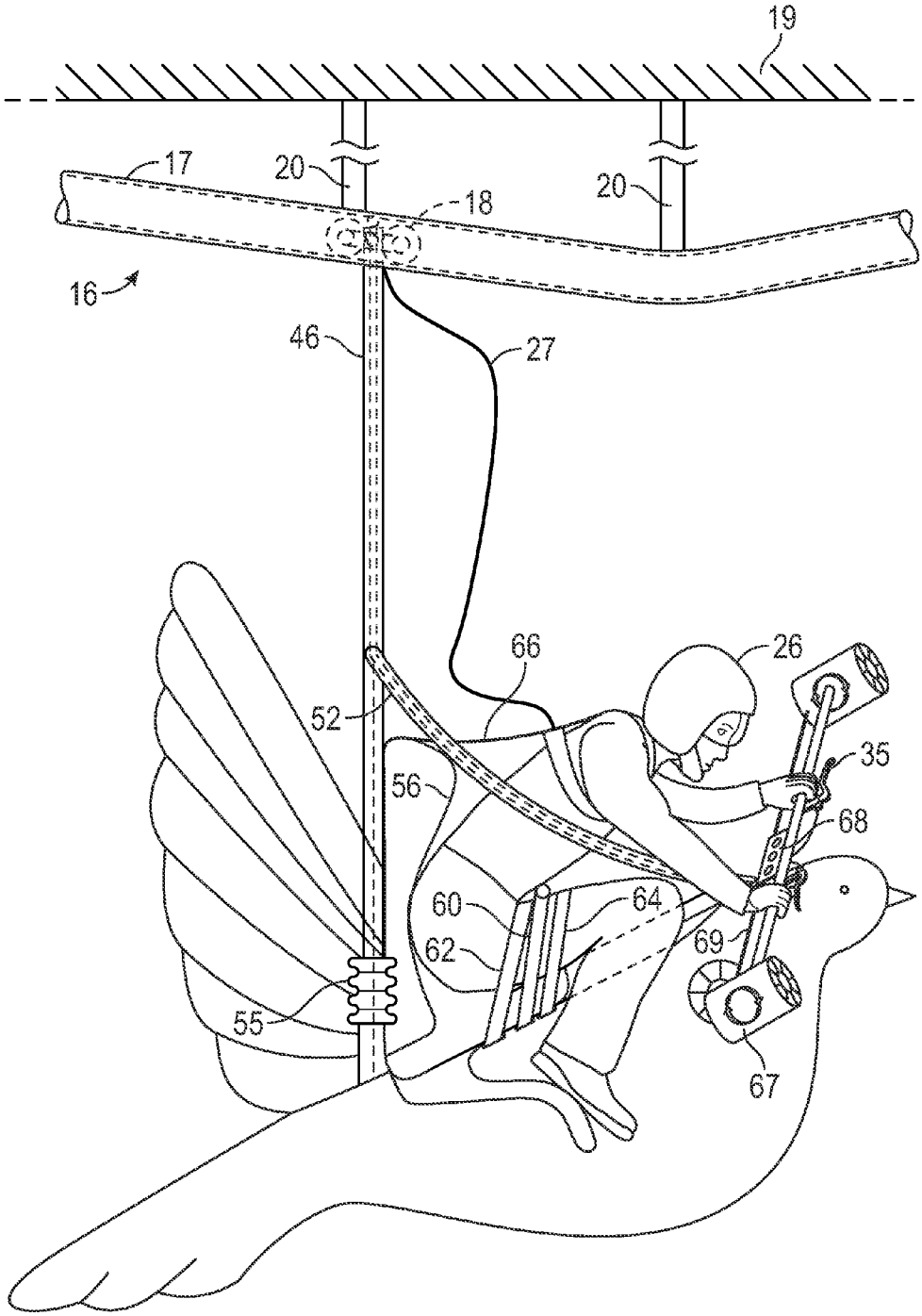
FIG. 17 is a diagrammatic illustration of an alternative bird harness.

FIG. 17 is a diagrammatic illustration of an alternative bird harness.

Figure 18:
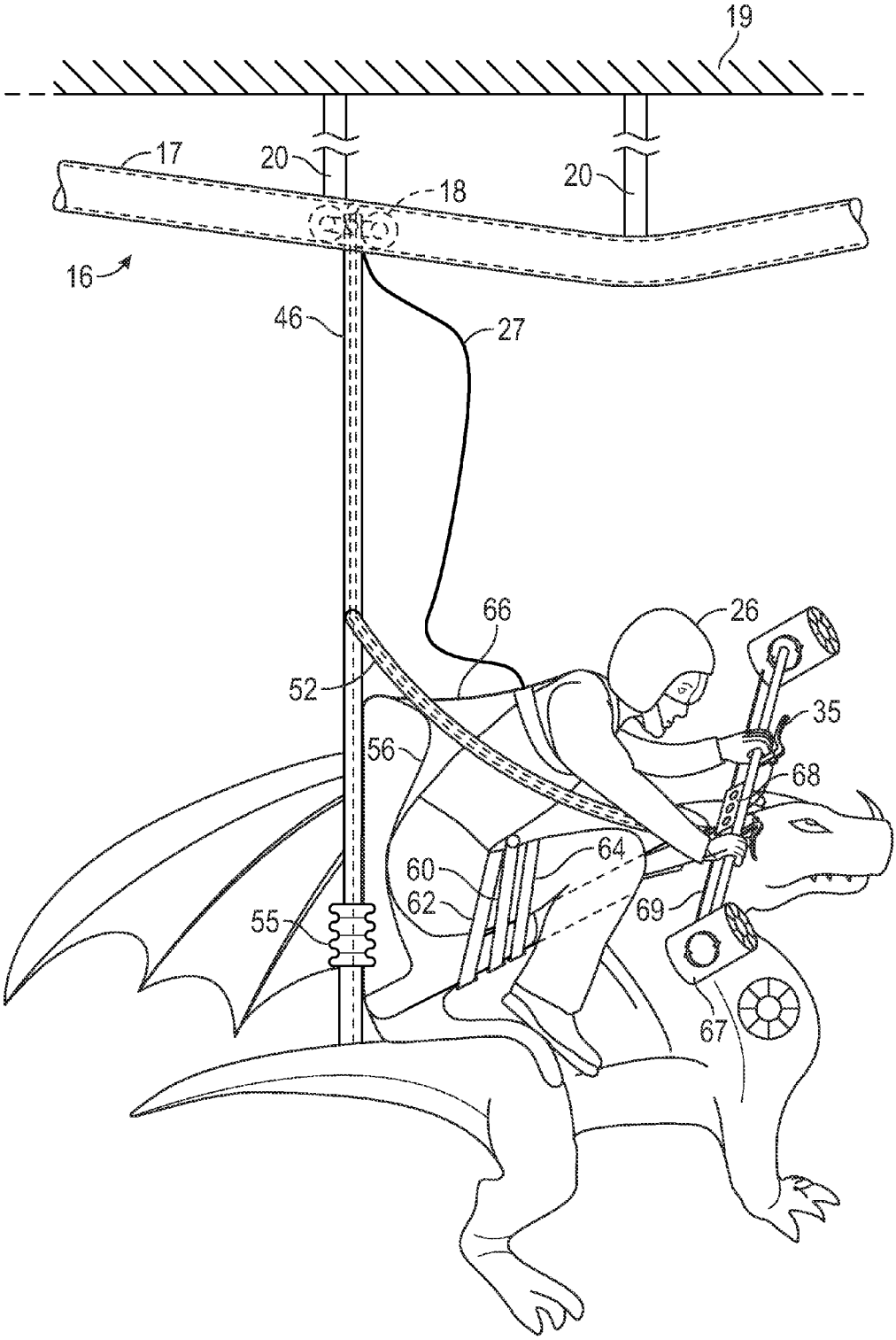
FIG. 18 is a diagrammatic illustration of an alternative dragon harness.

FIG. 18 is a diagrammatic illustration of an alternative dragon harness.

Alternative decorative harnesses of FIGS. 10-18 are illustrated as including one or more optional thrusters 67, thruster controller 68 and connection 69.

Additional fanciful harness configurations include but are not limited to:

Sea Creatures: Dolphin, Shark, Whale, Sea Turtle, Sting Ray, even a Surfer on a Wave harness.

Fairytale Creatures: Fairies, Dragons, Flying Carpet, Basilisk, Hippogriff, Gryphon, Gnomes, Elves, Unicorns, Genies, Hobbits, Pegasus, even a Bubble that would enclose the rider.

Desert Creatures: Lions, Tigers, Bears, Elephant, Leopard, Warthog, Hyena, Water-Buffalo, Giraffe, Rhino and so on.

Forest Creatures: Bears, Elk, Moose, Deer, Badgers, Beavers, Eagles, and so forth.

Birds: Eagle, Condor, Egret, Hawk, Falcon, Barn Owl, Swift, Cardinal, Sparrow, Hummingbird. For progressively easier runs suitable for younger or first time riders, for example, the smaller the bird the smaller the ride.

Garden Creatures: Butterflies, Birds, Moths, Frogs, Lizards, Wasps, Bees, Squirrels, Earthworms, and so forth.

Weather: Storm clouds, Lightning bolts, Stars, Planets, Moons, the Winds and the like.

Jungle Creatures: Apes, Monkeys, Panthers, Snakes, and so forth.

Insects: Giant Ants, Butterflies, Moths, Beetles, and the like.

Vehicles: Planes, Spaceships, Cars, Motorcycles, Tanks, Jeeps, Ornithopters, and so forth.

Fantasy/Science Fiction: Aliens, Zombies, Vampires, Werewolves, the Undead, Evil Pirates, and so forth.

Additional harness forms include licensed figures from film and television tie-ins:

Super Heroes: Superman®, Batman®, Wonder Woman® and her Invisible Plane, Spiderman®, Storm (X-Men®), and so on.

Harry Potter®: the Broom Fuselage, Hippogriffs, Nargels, Dementors, Dragons, and so on.

Aladdin®: The Genie, the Flying Carpet, and so on.

Transformers®: Cars that become Robots as you fly!

Star Wars®: X-Wing fighters, Tie Fighters, Millennium Falcon, and the like.

Star Trek®: The Enterprise, the Galileo Seven, and so on.

Futurama®

Battlestar Gallactica®

Shrek®

Cars®

Dora the Explorer®

The present disclosure contemplates at least two types of harnesses 28, one type is a suspension harness wherein the harness fastens to the back of the user and the user is suspended from the harness, and a second type is a ride-able harness, wherein the user straddles, sits or otherwise mounts the harness.

Many modifications and other embodiments of the system and apparatus described herein will come to mind to one skilled in the art to which this disclosure pertains having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method for achieving simulated personal flight, the method comprising the steps of:

a. providing a support structure;

b. providing a rail attached to the support structure and having an elevated takeoff terminus and a landing terminus to provide a path of travel from the takeoff terminus to the landing terminus;

c. providing a carriage moveably coupled to the rail;

d. providing a user-operated means for braking the carriage;

e. providing a brake conduit depending from the carriage and connected to the user-operated means for braking the carriage;

f. depending from the carriage a harness for securing a user;

g. providing an elastic connector connecting the brake conduit to the harness, h. securing a user to the harness at the takeoff terminus; and i. following the path of travel from the takeoff terminus to the landing terminus.

2. The method of claim 1, further comprising providing one or more thrusters pivotally mounted to the harness and further comprising the step of using the one or more thrusters to modify the manner of following the path of travel.

3. The method of claim 2, further providing a control panel to operate the one or more thrusters.

4. The method of claim 1, wherein the path of travel comprises one or more curves.

5. The method of claim 1, wherein the provided harness is decorative.

6. The method of claim 1, further comprising providing a return rail that connects the landing terminus to the takeoff terminus to return the harness to the takeoff terminus from the landing terminus.

7. The method of claim 6, further comprising the step of returning the harness to the takeoff terminus from the landing terminus with the return rail, whereby a user secured in the harness effectuates a user-controlled descent from the takeoff terminus to the landing terminus, exits the harness at the landing terminus whereupon the empty harness is returned to the takeoff terminus.

* * * * *